US005879249A

United States Patent [19]

Fox-Gurcay

[11] Patent Number: 5,879,249

[45] Date of Patent: Mar. 9, 1999

[54] SCOREKEEPING APPARATUS FOR A TENNIS RACQUET

[76] Inventor: Gulden Fox-Gurcay, 8548 Vine Valley Dr., Sun Valley, Calif. 91352

[21] Appl. No.: 975,076

[22] Filed: Nov. 20, 1997

Related U.S. Application Data

[60] Provisional application No. 60/031,232 Nov. 25, 1996.

[51] Int. Cl. [6] ..... A63B 49/00

[52] U.S. Cl. ..... 473/553

[58] Field of Search ..... 473/553, 171; 273/DIG. 26; 116/222, 321, 281, 225

[56] References Cited

U.S. PATENT DOCUMENTS

| | | | |
|---|---|---|---|
| 3,986,715 | 10/1976 | Glick | 473/553 |
| 4,158,342 | 6/1979 | Scruggs . | |
| 4,164,910 | 8/1979 | Feiler . | |
| 4,172,595 | 10/1979 | Sewell . | |
| 4,202,544 | 5/1980 | Popma . | |
| 4,331,098 | 5/1982 | Rubano . | |
| 4,357,895 | 11/1982 | Nightingale . | |
| 4,498,668 | 2/1985 | Bowen . | |
| 4,557,215 | 12/1985 | Petersson . | |
| 4,738,449 | 4/1988 | Droz . | |
| 5,134,565 | 7/1992 | Herbertz . | |
| 5,174,568 | 12/1992 | You . | |
| 5,385,113 | 1/1995 | Hierath . | |
| 5,489,122 | 2/1996 | Pittner . | |

FOREIGN PATENT DOCUMENTS

| | | |
|---|---|---|
| 0024552 | 3/1998 | European Pat. Off. . |
| 2460689 | 3/1981 | France . |
| 2053003 | 2/1981 | United Kingdom . |

*Primary Examiner*—Raleigh W. Chiu
*Attorney, Agent, or Firm*—Richard C. Litman

[57] ABSTRACT

An apparatus for keeping the score of a game of which a generic form is suitable for adaptation to both retrofit use as well as an integral shaping of a tennis racquet. The generic form of the present invention includes an array of scoring indicia displayed in a column on an elongated element. The elongated element is disposed on a branch or shaft of a tennis racquet in combination with a score marking element. The score marking element comprises an elastic loop which encircles the branch or shaft and selectively resides upon the scoring indicia of the elongated element. Several embodiments of the generic form are described.

5 Claims, 2 Drawing Sheets

SCOREKEEPING APPARATUS FOR A TENNIS RACQUET

CROSS-REFERENCE TO RELATED APPLICATION

This application claims the benefit of U.S. Provisional Patent Application Ser. No. 60/031,232, filed Nov. 25, 1996.

BACKGROUND OF THE INVENTION

1. Field of the Invention

The present invention relates generally to devices for keeping track of scores during a sporting game. More specifically, the invention provides an assembly including an elongated element having score indicia thereon and a slidable score marking element, which assembly resides on the frame of a tennis racquet for manipulation by a player to mark the game score as play progresses.

2. Description of the Prior Art

Tennis players, like many athletes, often focus more attention on their game performance than on remembering the score of a game. As a result, players may find themselves in need of a memory aid to help keep track of the score.

A scorekeeping device is therefore useful in these and other situations where a need exists for providing a player with a quick and convenient way to keep track of game scores. One solution meeting such a need is to provide a score keeping device which is mounted on a tennis racquet frame. Typically, a tennis racquet frame has a head, a throat, a shaft and a grip. The throat of the racket may be solid and integral with the shaft or, as found in many composite and metal racquets, consist of two elongated branches bridging the head to a short shaft which, in turn, immediately transforms into a grip. Whereas racquet-mounted devices known in the prior art are generally adequately structured to track the score of a game, such devices exhibit disadvantages, such as being obstructive to the use and playing qualities of the tennis racquets, heretofore not considered or addressed. Such disadvantages are particularly magnified in view of recent high-tech improvements in the composites and methods available for molding modern tennis racquets.

For example, U.S. Pat. No. 5,489,122 issued on Feb. 6, 1996 to Pittner discloses a score keeping device which includes a single strip of sheet material bearing a rectangular matrix of squares of three columns bearing tennis scoring indicia for both players on the same sheet. Slidable scoring markers, being tinted translucent plastic windows, are juxtaposed over the squares to indicate the present game and set score for two tennis players or teams. The scoring markers have L-shaped fingers which are set in channels provided in the sheet material. A similar device using a slotted plate and movable buttons attached by bands to the shaft is shown in European Pat. Office Patentanmeldung No. 0 024 552 published Jul. 24, 1980.

Numerous disadvantages are incumbent with such systems. First, unlike the present invention, by providing score indicia in a multiple-columned manner on a single adhesive sheet, each device limits the maximum size of the sheet to the width and length of the shaft of a tennis racquet, thereby limiting the readable size of the score indicia. Whereas such configuration may have been suitable for the old, solid wooden-shafted tennis racquet, sheet size limitations are particularly problematic in modern racquets having shafts and open throats of reduced surface area. Second, under conditions of changing sunlight or artificial lighting, the tinted windows of the Pittner device may not consistently and desirably display the score. Finally, the scoring markers are slidably retained only by channels formed in the sheet material, which in the Pittner device is a grooved adhesive sheet material and in the European patent is a slotted plate. Such structure requires a substantial thickness of both the sheet material and the markers in order to maintain a rigidity and ruggedness of form. Such bulk added on or near the shaft of a tennis racquet is highly likely to interfere with proper racquet handling technique and adds undesirable weight and imbalance to the racquet.

Other structural variations of shaft-mounted scorekeeping devices are known. In U.S. Pat. No. 4,498,668 issued on Feb. 12, 1985 to Bowen, a device includes a single column of score indicia superimposed on a transparent tubular housing having sealed ends, a column of score indicia superimposed thereon, and a sliding, contrastingly-colored chip within the tubular housing capable of being repositioned by a pinching action, whereby a bulge of the tubular housing is created to emphasize the score. U.S. Pat. No. 4,331,098 issued on May 25, 1982 to Rubano discloses a tennis score keeping device having ratchet teeth, a plastic panel and frame, and plastic arrows. U.S. Pat. No. 4,202,544 issued May 13, 1980 to Popma describes a series of elastic bands having scoring indicia which slip onto the shaft above the grip of a racquet, operated by rotating the bands about the shaft to a predetermined location where an indicator dot represents which score indicia on the band is to be read to correctly identify the score. A solution avoiding the attachment of a scorekeeping device to the shaft is suggested by U.S. Pat. No. 4,172,595 issued Oct. 30, 1979 to Sewell, which describes a tennis tally board adapted to be attached to the butt end of the grip.

Because a tennis player often grasps his racquet at different portions of the shaft during a game, each of these noted devices may permit unintentional movement of the movable elements and, more undesirably, are often limited to placement on the shaft as a retrofit device, which can interfere with the player's stroke technique. Moreover, most of such devices add undesirable mass and volume to a tennis racquet which adversely affect the playing characteristics of a racquet, such as its weight and balance. Any outwardly protruding bodies of such devices are further vulnerable to damage or dislocation during the course of a game, especially if the racquet is dropped or propelled into an object.

Numerous other less relevant structures have been proposed to aid in tracking a tennis score. U.S. Pat. No. 5,134,565 issued Jul. 28, 1992 to Herbertz describes an electronic scorekeeping watch. U.S. Pat. No. 4,738,449 issued Apr. 19, 1988 to Droz describes a base with three slots arranged in a U-form along which a cursor is moved, such base being capable of attachment to the strings of a racquet. Each of U.S. Pat. No. 4,557,215 issued Dec. 10, 1985 to Petersson, U.S. Pat. No. 4,158,342 issued Jun. 19, 1979 to Scruggs, and U.S. Pat. No. 4,164,910 issued Aug. 21, 1979 to Feiler describe an absorbent wrist band and counter device showing score indicia and markers which are relocated about the wrist band. U.S. Pat. No. 4,357,895 issued Nov. 9, 1982 and UK Pat. Application No. 2 053 003 published Feb. 4, 1981, both by Nightingale, describes a score board with engaging markers having plunger activated features. French De Brevet D'Invention No. 79 08001 dated Mar. 6, 1981 describes a spring-loaded ball and detent assembly integrally formed within the grip.

None of the above inventions and patents, taken either singly or in combination, is seen to describe the instant invention as claimed. Thus, a need still exists for an unobtrusive device which enables a player to easily keep score of a tennis match.

SUMMARY OF THE INVENTION

In view of the foregoing disadvantages inherent in the known types of tennis scorekeeping devices found in the prior art, it is a primary object to provide a scorekeeping apparatus which does not add significant mass or volume to a tennis racquet and does not interfere with the playing characteristics of the racquet.

It is another object of the invention to provide a tennis scorekeeping device on a tennis racquet which is easily and quickly accessible and operable, with a simplicity in number and structure of parts.

It is a further object of the invention to provide a tennis score keeping device which may be integrally provided as part of the tennis racquet.

Still another object of the invention is to offer a tennis score keeping device which is easy to view and rugged in construction.

Yet another object of the present invention is to provide improved elements and arrangements thereof in an apparatus for the purposes described which is inexpensive, dependable, and fully effective in accomplishing its intended purposes.

In accordance with the objects of the invention, an apparatus is provided for keeping the score of a game, of which a generic form is suitable for adaptation to both retrofit use as well as an integral shaping of a tennis racquet. The generic form of the present invention includes an array of scoring indicia displayed in a column on an elongated element in combination with a score marking element. The elongated element is disposed on a branch or shaft of a tennis racquet. The score marking element is an elastic loop which encircles the branch or shaft and selectively resides upon the scoring indicia of the elongated element. Several embodiments of the generic form are described.

A first embodiment is directed towards an apparatus which is retrofitted onto a conventional racquet. In this embodiment, the elongated element comprises a molded strip having on its upper surface a series of transverse concave depressions separated by slight ridges. An adhesive is applied to the under surface of the strip which allows it to be secured to a preferred portion of the tennis racquet frame.

A second and a third embodiment is directed towards an apparatus which is integrally molded as part of the frame of the racquet. In these embodiments, the elongated element may comprise one of two versions. Similar to the retrofit embodiment, a preferred portion of the racquet frame, preferably each branch, is integrally molded with the series of concave depressions and ridges, thereby defining the elongated element as an integral molded member of the shaft or branch. In the alternative version, the ridges and depressions may be omitted such that the standard appearance of the frame as originally molded is maintained, but wherein the scoring indicia are integrally applied by tennis racquet molding processes known in the prior art using color pigments and appearing on the surface of the racquet under a clear coat. Such color pigment methods of applying scoring indicia may be used to apply scoring indicia to either of the embodiments.

Each of the first, second and third embodiments include additional common elements. First, the score marking element is an elastic loop which encircles the portion of the tennis racquet frame upon which the strip is mounted. The elastic loop should preferably be round in cross section to allow for a smooth rolling or sliding action over the frame of the racquet. For example, the elastic loop may be comprised of an elastic cord having a tubular metal crimp or clasp attaching the ends of the cord to itself. This tubular crimp or clasp serves the dual purposes of allowing the score marking element to be closely attached around a branch of the racquet as well as serving as a rollable marker. The tubular characteristic allows the crimp to be rolled or slipped from indicia to indicia to change the score, yet to securely rest in the concave depression of the molded strip while not manipulated.

Next, a plurality of score indicia are arranged on the elongated member in an orderly array, each concave depression being dedicated to a single score indicia, whereby the elongated element is arranged to sequentially indicate each possible score for one of the two opponents in a game of tennis (whether singles or doubles). For example, the score indicia may be arrayed to read "LV," "15," "30," "40," and "AD," or some variation thereof. Preferably, at least a pair of such elongated members are included for a single racquet so that each one of the pair of elongated members may be used to represent one of the two opponents. However, any number of elongated members and score marking elements may be provided to include other dedicated scoring indicia, such as for set score, personal statistics of the players, and the like. Moreover, each of the elongated strip and score marking element combinations may be uniquely colored to better assist the user in remembering which player is represented by each of the score marking elements.

In a fourth embodiment, the scorekeeping is accomplished by electronic components which are integrated by circuitry and disposed within the shaft of the racquet frame or upon the butt end of the racquet grip. Specifically, the electronic components include a microprocessor, a plurality of push-buttons and a display screen. The push-buttons are manually depressed to input the point score data into the microprocessor. The microprocessor interprets the input signals provided by the push-buttons to calculate the new score, and produces an output which is displayed on the display screen. Preferably, at least two sets of push-buttons are employed, each set dedicated to inputting one player's score. By depressing the appropriate push-button corresponding to a given opponent, the displayed score or other statistics may be changed and tracked. Also, for the shaft version of the embodiment, the two sets of push-buttons are preferably disposed and segregated along each one of the branches of the racquet, whereby one branch represents one opponent and the other branch represents the other opponent.

Finally, although the preferred method of construction of the integral embodiments of the present invention is to mold the elongated element into the frame, numerous other methods and structures for application of the elongated element to the frame as an integral member may be envisioned as part of the present invention. One such method may include inlay of the retrofit device into a predetermined recess of the frame. Moreover, the score marking elements may be rigid and constructed from an inelastic, lightweight material, such as a plastic or metal.

The stated and other objects of the present invention will become readily apparent upon further review of the following specification and drawings.

BRIEF DESCRIPTION OF THE DRAWINGS

Similar reference characters denote similar or corresponding parts or features consistently throughout the attached drawings.

DETAILED DESCRIPTION OF THE PREFERRED EMBODIMENTS

Figure 1:
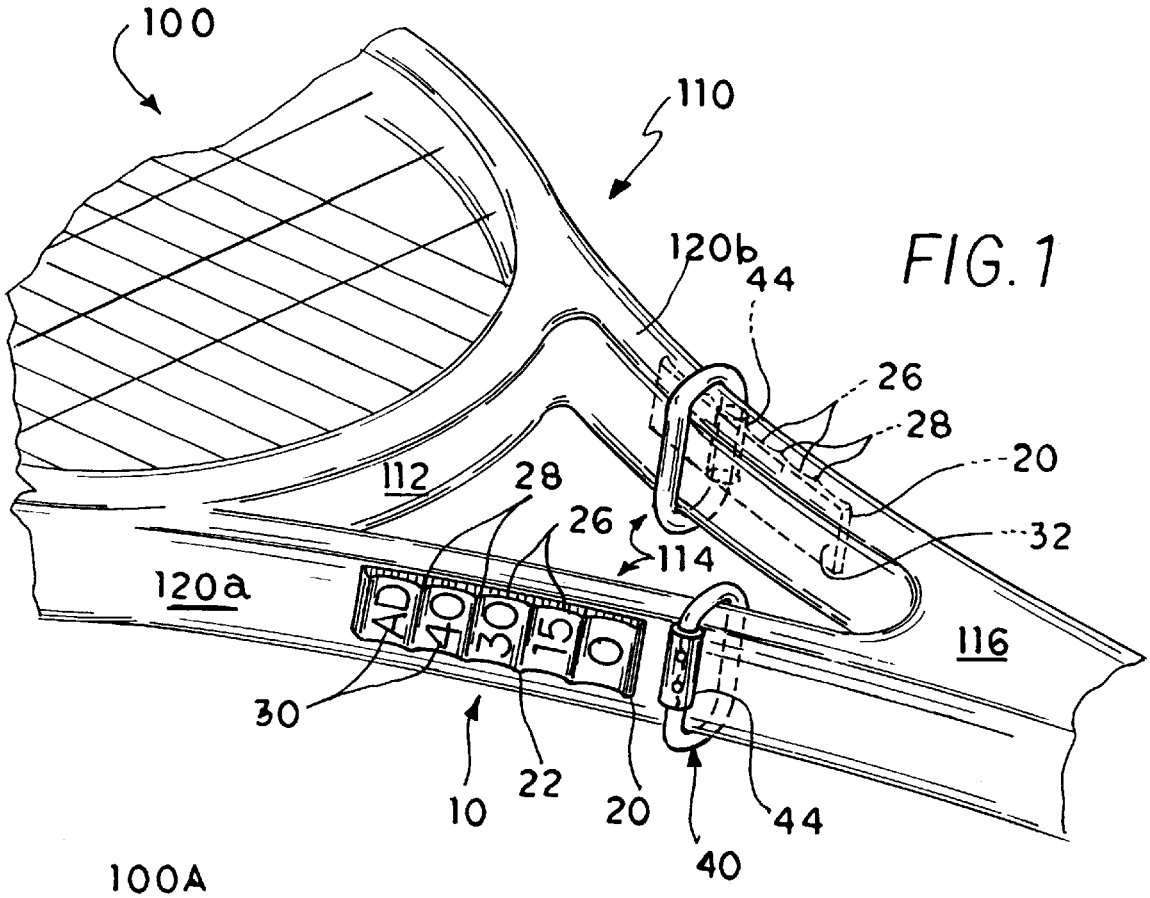
FIG. 1 is an environmental, perspective view of a first embodiment of a scorekeeping assembly as attached in use to a tennis racquet.

The present invention relates to an apparatus for keeping the score of a tennis game, of which a generic form is suitable for adaptation to both retrofit use as well as an integral shaping of a tennis racquet. By referring to the several FIGS. 1 through 3, the common generic elements will become apparent as described below. As a matter of background, typically, a modern tennis racquet 100 has a frame 110 comprising a head 112, a throat 114, a shaft 116 and a grip 118. Although the throat 114 may be solid as found in traditional wooden tennis racquets, in modern composite racquets and metal racquets, the throat is open and consists of two elongated branches 120*a*,120*b* bridging the head 112 to a short shaft 116 immediately transforming into a grip 118. Such structure limits suitable functional design for scorekeeping devices.

Figure 3:
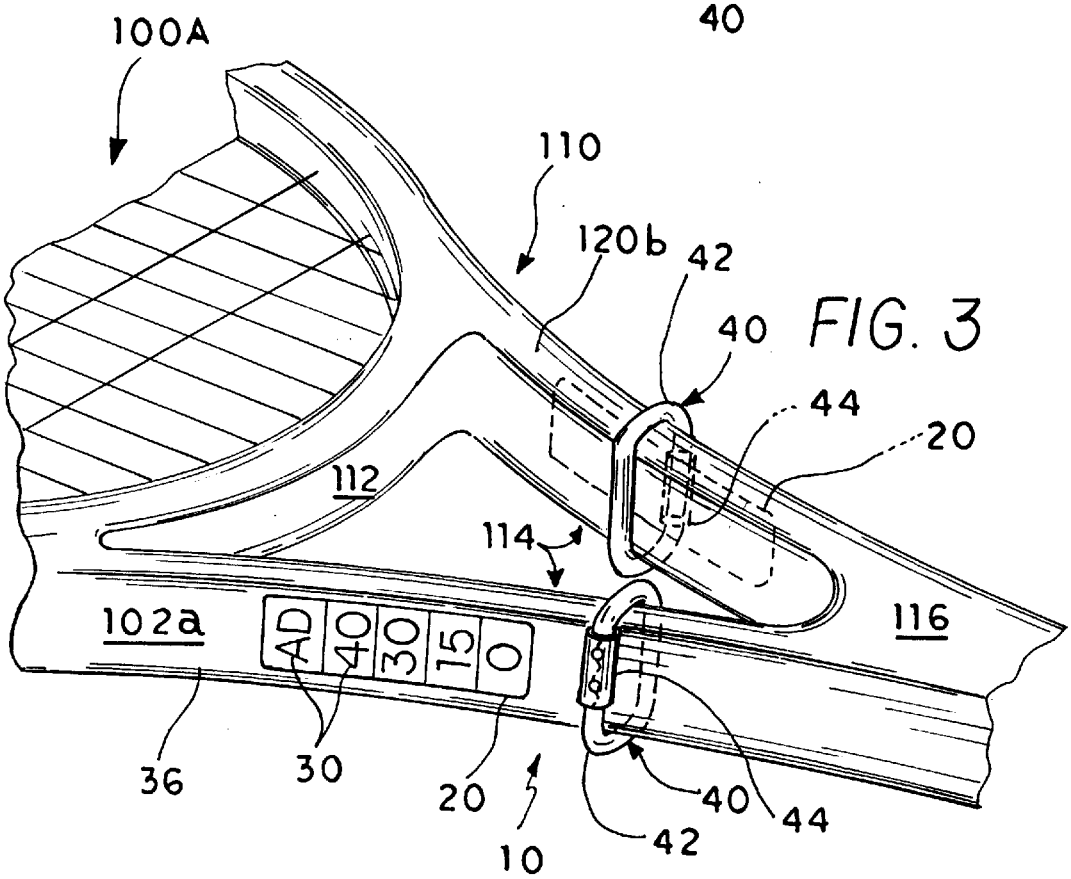
FIG. 3 is a perspective view of the third embodiment of the scorekeeping assembly wherein the elongated element is integrally molded into a tennis racquet.

The present invention in its generic form provides a scorekeeping assembly 10 including an elongated element 20 having score indicia 30 thereon and a slidable score marking element 40. The assembly 10 resides on the frame 110 of a tennis racquet 100, either as a retrofit device as shown in FIG. 1, or as an integral part of the frame 110 as shown in FIG. 2 and FIG. 3, for manipulation by a player to mark the game score as play progresses.

The elongated element 20 is defined by an array of score indicia 30 displayed as a column along the longitudinal axis of the elongated element 20. The elongated element 20 is disposed on a branch 120 or shaft 116 of a tennis racquet 100 in combination with the score marking element 40. The score marking element 40 is an elastic loop which encircles the branch 120 or shaft 116 and selectively resides upon the scoring indicia 30 of the elongated element 20. The elastic loop is comprised of an elastic cord 42, such as a fabric-covered, rubberized band or bungee-type cord, having an attachment means 44 to form the loop. The cord 42 is round in cross section to allow for a smooth rolling or sliding action over the frame of the racquet. Each of the score marking elements 40 is dimensioned to closely encircle the branch 120 or shaft 116 of the racket such that the elastic is under slight tension to exert a securing force against the frame 110.

Figure 2:
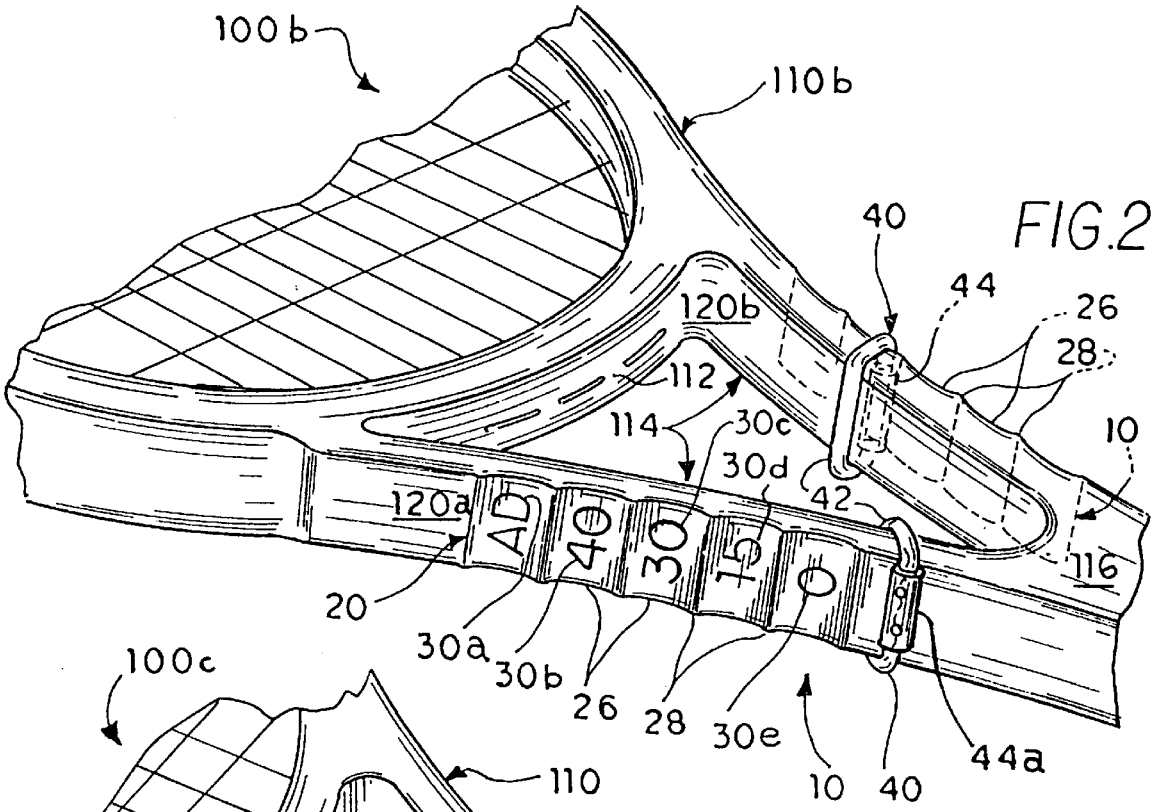
FIG. 2 is a perspective view of the second embodiment of the scorekeeping assembly wherein an elongated element is integrally molded into a tennis racquet.

Focusing now on each of the elements and embodiments individually, in FIG. 1 a first embodiment of the scorekeeping assembly 10 is shown as a retrofit device which can be attached to a preexisting tennis racquet 100. As in the generic form, the assembly 10 comprises an elongated element 20 and a score marking element 40.

The elongated element 20 comprises a molded strip having an upper surface 22 on which a series of transverse concave depressions 26 are formed, thereby defining slight ridges 28 separating each of the concave depressions 26. On the under surface 32 of the molded strip, an adhesive layer (not shown) is applied which allows the strip to be secured to a preferred portion of the tennis racquet frame 110. Suggested materials suitable for molding the strip may include foamed plastics, such as urethanes, which are easily molded to the desired configuration and pigmented in accordance with the desired indicia. Self-stick adhesives may be applied to the under surface 32 to form the adhesive layer, to which a release liner (not shown) may be added for storage and distribution prior to sale and application of the strip to the frame 110 of a racquet 100.

In contrast, the elongated element 20 in FIG. 2 is integrally molded as part of composite materials of the frame of the racquet thereby defining tennis racquet 100*b*. Similar to the retrofit species, a preferred portion of the racquet frame, preferably each branch 120*a*,120*b*, is integrally molded during a conventional racquet manufacturing process with the series of concave depressions 26 and ridges 28, thereby defining the elongated element 20 as an integral molded member of the frame 110*b*.

In an alternative integral version of the elongated element 20 as shown in FIG. 3 as the third embodiment (racquet 100*a*), the ridges and depressions are omitted such that the standard appearance of the frame 110 as originally molded during a racquet manufacturing process is maintained. In lieu of the ridges, the scoring indicia 30 are integrally applied by tennis racquet molding processes known in the prior art using color pigments and appearing on the surface of the molded frame as indicia 30 under a clear coat (represented by shading lines 36). An example of a product formed by such molding and pigmenting processes known in the prior art is the HEAD® Radical Tour Mid Plus™ tennis racquet manufactured by Head Sports, Inc., Boulder, Colo. Such color pigmentation methods are preferably used to apply the scoring indicia 30 to either of the embodiments on the branches 120*a*,120*b* in a columnar array or configuration as described below consistent with the use of the present invention.

In all of the embodiments, a plurality of score indicia 30 are arranged on the elongated member in an orderly and columnar array. With particular reference to the embodiments of FIG. 1 and FIG. 2, each concave depression 26 is dedicated to a different single score indicia 30*a*,30*b*,30*c*, 30*d*,30*e* (numbered for clarity only in FIG. 2). Each different score indicia 30*a–e* is arranged on the elongated element 20 to sequentially indicate each possible score for one of the two opponents in a game of tennis. Obviously, the placement and number of assemblies 10 provided on the frame 110 is dependent upon the various types of score indicia 30 desired to be tracked. Hence, any number of elongated elements 20 and score marking elements 40 may be provided to include other dedicated scoring indicia, such as for set score, personal statistics of each player, and the like. The alphanumeric game score indicia as represented in FIGS. 1 through 3 are merely exemplary of the various different indicia which may be useful or desirable to track by the present scorekeeping assembly.

However for purposes of discussion, in FIG. 1 a game score of one player is shown. For example, the different score indicia 30 may be arrayed to read "0," "15," "30," "40," and "AD," or some variation thereof. In the preferred embodiment of the invention, at least a pair of such elongated members 20 are included for a single racquet 100 such that each one of the pair of elongated members 20 may be used to represent one of the two opponents. Each one of the pair may be preferably located on opposite branches 120*a*, 120*b* of the racquet frame 110. Moreover, the assemblies are visually distinguishable by an identifying feature, and are preferably color coded, in order to represent each opponent in a game of tennis.

Having thus arranged the scoring indicia 30 on a given elongated element 20, the score marking element 40 is used to indicate the score by its proximity to the chosen score indicia. It is particularly noted that none of the prior art devices are suited or adaptable for use on the throat branches 120*a*,120*b* of a modern tennis racquet in as much as none have the benefit of the present attachment means 44 which allows the elastic loop to be formed around a branch 120. As can be seen in each of the FIGS. 1 through 3, the elastic cord 42 is secured onto itself to form the elastic loop by the attachment means 44, which may be a tubular metal crimp 44*a,* or bi-partite barrel clasp (not shown), attached to each end of the cord 42. If a crimp is used, the elastic loop may be permanently attached to the racquet and not intended for removal. If a clasp is used, the elastic loop may be removable from the racquet frame.

When used with the molded strip of FIG. 1, either the barrel clasp or tubular crimp attachment means 44 serves a dual purpose. As previously noted, the score marking element 40 is allowed to be closely attached around a branch 120 of the racquet. However, the preferred tubular characteristic of the crimp or clasp 44 also allows it to be rolled or slipped from indicia to indicia 30 to change the score while securely resting in the concave depression 26 of the molded strip while not manipulated. Thus, by simple manual manipulation, the elastic loop is slipped or rolled over a next successive ridge 28 to lie proximate to a different score indicia 30 representing the appropriate score achieved by the player represented by that assembly 10. The score marking element 40 performs in a similar manner for the second embodiment of FIG. 3.

Figure 4:
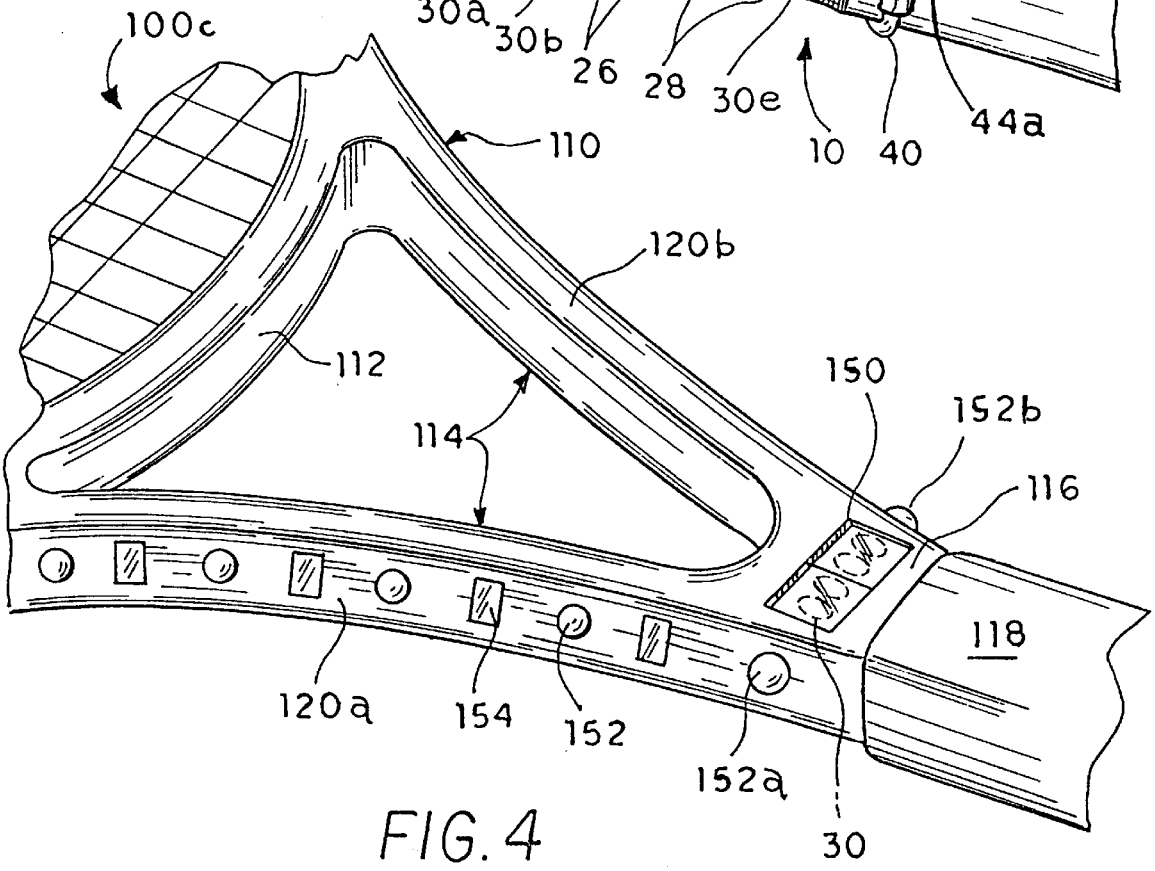
FIG. 4 is a perspective view of a fourth embodiment of a scorekeeping assembly having electronic components integrated into a tennis racquet.

Turning now to a fourth embodiment in FIG. 4, the scorekeeping device of the present invention is comprised of electronic components such as a microprocessor having integrated circuitry and a portable power source, such as a battery, (not shown) disposed within the frame 110 of the racquet 100. The external appearance of the scorekeeping device includes a display screen 150 disposed in the shaft 116, or butt end of the grip 118 (not shown) . A suggested display screen 150 may include an liquid crystal display, or other suitable display known in the prior art. The circuitry is electronically altered to display score indicia 30 by manually depressing one of a plurality of push-buttons 152 wherein each is dedicated to a different score indicia. The push-buttons 152 may be rubber coated, solid-state contacts which activate the dedicated circuits so that when the user presses the push-button associated with a given score or statistic of a given opponent, only that score indicia aspect of the display changes.

For example, two sets of dedicated push-buttons 152 are disposed and segregated along each one of the branches 120*a*,120*b* of the racquet. As shown in FIG. 4, a first branch 120*a* represents a first opponent and the second branch 120*b* represents the second opponent (not shown, hidden view). If the score of a game is 15–30 (where the server is the first opponent with a score of 15 and the second opponent is the receiver with a score of 30) and the score has just changed to 30—30, the display screen 150 would still read 30–15 until input is received. To change the display of the score indicia for the first opponent, the user of the scorekeeping device depresses one of the two push-buttons disposed on each side of the display screen 150 which correspond to the game score of the first opponent, namely the push-button 152*a,* which then advances the display to the next sequential score indicia, namely 30. By virtue of the dedicated circuit for the "game score" push buttons, the circuitry integrated to alter the display of the score of the second opponent to "30" causes the score in the display screen 150 to read 30—30. The second push-button 152*b* controls the score indicia of the second opponent in a similar manner.

Other push-buttons 152 may be dedicated to other statistics, such as the set score, unforced errors, default serves, etc., which may be used to change and track the score indicia 30 presented in the display screen. Each such push-button may be labelled with identifying indicia 154, such as an adhesive label with printed indicia, or indicia inherently fabricated into the racquet frame itself.

It is to be understood that the present invention is not limited to the embodiments described above, but encompasses any and all embodiments within the scope of the following claims.

I claim:

1. A racquet comprising:

a head;

a grip;

a shaft, the shaft being contiguous with the grip;

a pair of elongated branches, each of said pair of elongated branches extending between a respective side of said head and said shaft;

a first plurality of score indicia sequentially arranged in a columnar array integrally formed on a first one of said pair of elongated branches during manufacture of the racket;

a second plurality of score indicia sequentially arranged in a columnar array integrally formed on a second one of said pair of elongated branches during manufacture of the racket;

a first elastic cord encircling said first one of said pair of elongated branches, said first elastic cord being dimensioned to be under tension when formed into a first loop;

first attachment means for securing said first elastic cord onto itself to form said first loop;

a second elastic cord encircling said second one of said pair of elongated branches, said second elastic cord being dimensioned to be under tension when formed into a second loop; and second attachment means for securing said second elastic cord onto itself to form said second loop;

whereby said first loop is positioned to lie proximate one of said first plurality of score indicia which represents a score of a first one of two opponents, and said second loop is positioned to lie proximate one of said second plurality of score indicia which represents a score of a second one of two opponents.

2. The racquet according to claim 1, wherein said first one of said pair of elongated branches has a first plurality of transverse concave depressions integrally formed thereon, said first plurality of transverse concave depressions corresponding in number to said first plurality of score indicia, and each of said first plurality of score indicia being provided proximate a respective one of said first plurality of transverse concave depressions, and wherein said second one of said pair of elongated branches has a second plurality of transverse concave depressions integrally formed thereon, said second plurality of transverse concave depressions corresponding in number to said second plurality of score indicia, and each of said second plurality of score indicia being provided proximate a respective one of said second plurality of transverse concave depressions.

3. The racquet according to claim 2 wherein said first attachment means is tubular such that said first attachment means will securely rest in a selected one of said first plurality of transverse concave depressions, and wherein said second attachment means is tubular such that said second attachment means will securely rest in a selected one of said second plurality of transverse concave depressions.

4. The racquet according to claim 3 wherein said first elastic cord and said second elastic cord are fabric-covered to reduce the tendency of each of said first loop and said second loop to slide relative to a respective one of said pair of elongated branches.

5. The racquet according to claim 3 wherein said first and second attachment means are tubular metal crimps.

* * * * *